US009761165B2

(12) United States Patent
Han

(10) Patent No.: US 9,761,165 B2
(45) Date of Patent: Sep. 12, 2017

(54) DISPLAY APPARATUS, POWER CONTROL MODULE AND POWER CONTROL METHOD THEREOF

(71) Applicant: SAMSUNG ELECTRONICS CO., LTD., Suwon-si (KR)

(72) Inventor: Jea-hee Han, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 247 days.

(21) Appl. No.: 14/792,708

(22) Filed: Jul. 7, 2015

(65) Prior Publication Data

US 2016/0027373 A1 Jan. 28, 2016

(30) Foreign Application Priority Data

Jul. 24, 2014 (KR) ..... 10-2014-0094205

(51) Int. Cl.
*G09G 5/00* (2006.01)
*G09G 3/20* (2006.01)

(52) U.S. Cl.
CPC ..... *G09G 3/20* (2013.01); *G09G 3/2092* (2013.01); *G09G 5/003* (2013.01); *G09G 2330/02* (2013.01); *G09G 2330/028* (2013.01)

(58) Field of Classification Search
CPC ..... G09G 3/20
USPC ..... 345/212
See application file for complete search history.

(56) References Cited

U.S. PATENT DOCUMENTS

2007/0035280 A1* 2/2007 Fujiyama ..... H03K 17/22 323/212
2009/0059681 A1* 3/2009 Park ..... G11C 5/147 365/189.07
2015/0358007 A1* 12/2015 Diffenderfer ..... H03K 5/13 327/241
2016/0013719 A1* 1/2016 Babazadeh ..... H02M 3/157 323/271

FOREIGN PATENT DOCUMENTS

KR 1999-017461 A 3/1999
KR 20-2009-0007644 U 7/2009

* cited by examiner

*Primary Examiner* — Jason Olson
(74) *Attorney, Agent, or Firm* — Sughrue Mion, PLLC

(57) ABSTRACT

A display apparatus includes a power supply for providing power, a circuit board including an integrated circuit (IC) with a central processing unit (CPU) that processes an image signal; and a display configured to display an image corresponding to the image signal; the IC includes a power controller configured to monitor a voltage level of a core voltage provided by the power supply to the IC and adjust a phase margin of a voltage corresponding to a voltage detected by the monitoring. Thus, a phase margin may be adjusted in accordance with a voltage of an IC, thereby compensating for voltage fluctuation due to instantaneously varying ripples and thus stably driving a system.

20 Claims, 7 Drawing Sheets

DISPLAY APPARATUS, POWER CONTROL MODULE AND POWER CONTROL METHOD THEREOF

CROSS-REFERENCE TO RELATED APPLICATION

This application claims priority from Korean Patent Application No. 10-2014-0094205, filed on Jul. 24, 2014, in the Korean Intellectual Property Office, the disclosure of which is incorporated herein by reference in its entirety.

BACKGROUND

1. Field

Apparatuses and methods consistent with exemplary embodiments relate to a display apparatus, a power control module and a power control method thereof, in which power is controlled in response to a voltage of an integrated circuit (IC) chip.

2. Description of the Related Art

A display apparatus such as a television (TV, e.g., a smart TV), a cellular phone (e.g., a smart phone), a tablet personal computer (PC), etc., may be provided with an integrated circuit (IC) chip as a main chip including a central processing unit (CPU), an application processor (AP), etc. The IC chip may be mounted to an image board typically provided as a main board, e.g., to a printed circuit board.

With recent technological advances, services and functions provided on portable devices have diversified. Accordingly, the load required of the IC chip has increased and the number of cores in the chip has increased.

On the other hand, for design purposes, ease of transport, etc., the size of the chip has been decreased, and a level of supply voltage has been decreased.

As the voltage supplied to the IC chip is decreased, a voltage tolerance becomes small and the IC chip is largely influenced by ripples generated in a voltage waveform.

In reality, some ripples are unavoidable during circuit operations since noise is generated within a printed circuit board (PCB) pattern. However, these ripples cause instantaneous fluctuation of voltage when the chip operates with high load, and therefore a problem such as latch-up, or the like, may arise.

Accordingly, it is necessary to compensate for the fluctuation of the voltage caused by the instantaneous ripples in order to build a system in which an integrated circuit (IC) chip is stably driven.

SUMMARY

According to an aspect of an exemplary embodiment, there is provided a display apparatus including: a power supply configured to provide power to components of the display apparatus; a circuit board; an integrated circuit (IC) mounted to the circuit board, the integrated circuit configured to process an image signal; and a display configured to display an image corresponding to the processed image signal, wherein the IC includes a power controller configured to monitor a voltage level of a core voltage provided by the power supply to the IC and adjust a phase margin of the core voltage based on the monitoring. Thus, a phase margin is adjusted in accordance with an actual voltage of an IC chip, thereby compensating for voltage fluctuation due to instantaneously varying ripples and thus stably driving a system.

The IC may include an interface that may be configured to perform data communication with an external memory, and wherein the power controller may be further configured to apply the adjusted phase margin to a voltage for the data communication of the interface. Thus, a stable margin may be secured in operation of a memory interface unit (MIU).

The external memory may be mounted to the circuit board.

The display apparatus may include a memory configured to store a plurality of phase margin values respectively corresponding to a plurality of preset voltage ranges, wherein the power controller may be further configured to adjust the phase margin to apply a phase margin value corresponding to a voltage range of the voltage. Thus, an optimal margin may be applicable in accordance with voltage sections.

The power controller may be further configured to analyze a CPU load caused by an execution of functions in the display apparatus, and monitor the voltage level of the core voltage provided to the IC in response to the CPU load being equal to or greater than a preset reference value. Thus, the phase margin may be selectively adjusted to improve an operation efficiency of an apparatus.

The display apparatus may include a memory configured to store information related to CPU load amounts corresponding to the functions of the display apparatus. Thus, an optimal margin may be secured corresponding to each function.

The display apparatus may include a comparator configured to compare the detected voltage with a preset reference voltage, wherein the power controller may be further configured to adjust the phase margin according to a comparison result of the comparator. Thus, the phase margin may be adjusted by a simple configuration.

The comparator may be further configured to compare the detected voltage with a plurality of preset reference voltages that respectively correspond to a plurality of preset voltage ranges, and wherein the power controller may be further configured to adjust the phase margin to apply a phase margin corresponding to a voltage range of the detected voltage, according to a comparison result of the comparator. Thus, an optimal phase margin may be easily determined in accordance with the respective sections.

According to an aspect of another exemplary embodiment, there is provided power control method of a display apparatus including a circuit board having an integrated circuit (IC) mounted thereto, the method includes: monitoring a voltage value of a core voltage provided from a power supply to the IC; and adjusting a phase margin of the core voltage based on the monitoring. Thus, a phase margin is adjusted in accordance with an actual voltage of an IC chip, thereby compensating for voltage fluctuation due to instantaneously varying ripples and thus stably driving a system.

The method may include applying the adjusted phase margin for data communication with an external memory. Thus, a stable margin may be secured in operation of a memory interface unit (MIU).

The method may include storing a phase margin table in which a plurality of phase margin values correspond to a plurality of preset voltage ranges. Thus, an optimal margin may be applicable in accordance with voltage sections.

The method may include analyzing a central processing unit (CPU) load caused by an execution of functions in the display apparatus, and in response to the CPU load being equal to or greater than a preset reference value, monitoring the voltage level of the core voltage provided to the IC.

Thus, the phase margin may be selectively adjusted to improve an operation efficiency of an apparatus.

The method may include storing a load table in which CPU load amounts correspond to the functions of the display apparatus. Thus, an optimal margin may be secured corresponding to each function.

The method may include comparing the detected voltage with a preset reference voltage, and adjusting the phase margin in accordance with a result of the comparing. Thus, the phase margin can be adjusted by a simple configuration. Thus, the phase margin can be adjusted by a simple configuration The method may include comparing the detected voltage with a plurality of preset reference voltages respectively corresponding to a plurality of preset voltage ranges; and adjusting the phase margin by applying a phase margin value corresponding to the preset voltage range of the detected voltage. Thus, an optimal phase margin may be easily determined in accordance with the respective sections.

According to an aspect of another exemplary embodiment, there is provided power control module provided in an integrated circuit (IC) including a central processing unit (CPU), the power control module including: a power controller configured to monitor a voltage level of a core voltage provided by a power supply to the IC, and adjust a phase margin of the core voltage based on the monitoring. Thus, a phase margin is adjusted in accordance with an actual voltage of an IC chip, thereby compensating for voltage fluctuation due to instantaneously varying ripples and thus stably driving a system.

The power controller may be further configured to apply the adjusted phase margin to a voltage for data communication between the IC and an external memory. Thus, a stable margin may be secured in operation of a memory interface unit (MIU).

The power control module may include a memory configured to store a plurality of phase margin values respectively corresponding to a plurality of preset voltage ranges, wherein the power controller may be further configured to adjust the phase margin to a value corresponding to the preset range of the detected voltage. Thus, an optimal margin may be applicable in accordance with voltage sections.

The power controller may further include a comparator configured to compare the detected voltage with a preset reference voltage, and adjust the phase margin according to a comparison result of the comparator. Thus, the phase margin can be adjusted by a simple configuration.

The comparator may be further configured to compare the detected voltage with a plurality of reference voltages respectively corresponding to a plurality of preset voltage ranges, and wherein the power controller may be further configured to adjust the phase margin to apply a phase margin corresponding to the preset voltage ranges of the detected voltage. Thus, an optimal phase margin may be easily determined in accordance with the respective sections.

BRIEF DESCRIPTION OF THE DRAWINGS

The above and/or other aspects should become apparent and more readily appreciated from the following description of exemplary embodiments, taken in conjunction with the accompanying drawings, in which.

DETAILED DESCRIPTION

Below, one or more exemplary embodiments will be described in detail with reference to accompanying drawings.

Figure 1:
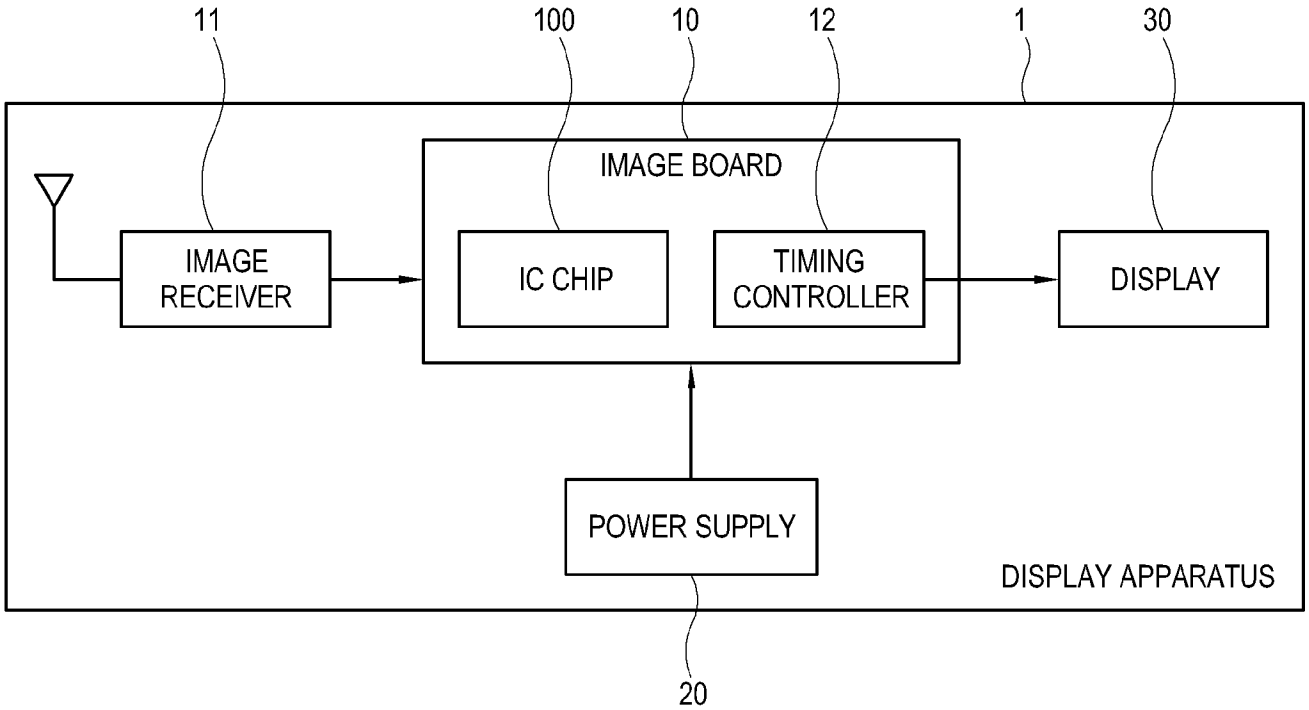
FIG. 1 is a block diagram illustrating a display apparatus according to an exemplary embodiment.

FIG. 1 is a block diagram illustrating a display apparatus according to an exemplary embodiment.

Display apparatus 1 processes an image signal provided from an external image source in accordance with a preset image process, and displays an image based on the processed signal.

According to an exemplary embodiment, the display apparatus 1 is achieved by a television (TV) that processes a broadcasting image based on a broadcasting signal/broadcasting information/broadcasting data received from a transmitter of a broadcasting station. However, exemplary embodiments are not limited to this example of the display apparatus 1. The display apparatus 1 may be achieved by various kinds of devices capable of processing an image, such as a smart phone, a smart pad, a tablet personal computer (PC), and other similar mobile devices.

Also, the kind of images displayable on the display apparatus 1 is not limited to a broadcasting image. For example, the display apparatus 1 may process a moving image, a still image, an application, an on-screen display (OSD), an image of a graphic user interface (GUI) for control of various operations, etc., based on a signal/data received from various image sources.

According to an exemplary embodiment, the display apparatus 1 may be achieved by a smart TV. The smart TV may receive and display a broadcasting signal in real time and have a web browser function so that the broadcasting signal can be displayed in real time and various contents can be searched and consumed through the Internet. In this way, the smart TV may provide convenient user environments. Also, the smart TV may include an open software platform to provide interactive service to a user. Therefore, the smart TV can provide various contents through the open software platform and, for example, offer an application for a predetermined service to a user. Such an application may refer to an application program capable of providing various kinds of service such as a social network service (SNS), finance information, news, weather, maps, music, movie, games, electronic books, etc.

As shown in FIG. 1, the display apparatus 1 includes an image receiver 11 for receiving an image signal, an image board 10 (e.g., a circuit board) provided with an image processor for processing the image signal received by the image receiver 11, a display 30 for displaying an image based on the image signal processed by the image processor, and a power supply 20 for supplying power to components of the display apparatus 1.

The image receiver 11 receives an image signal and sends the received image signal to the image processor. The image receiver 11 may be achieved in various ways in accordance with the formats of the image signal and the types of the display apparatus 1. For example, the image receiver 11 may wirelessly receive a radio frequency (RF) signal from a broadcasting station, or may receive the image signal through a wire based on composite video, component video, super video, SCART, high definition multimedia interface (HDMI), or other similar standards. If the image signal is a broadcasting signal, the image receiver 11 includes a tuner for selecting a channel to receive the broadcasting signal.

FIG. 1 shows an example in which the image receiver is separated from the image board 10, but exemplary embodiments are not limited thereto. For example, the image receiver 11, e.g., the tuner, may be provided in the image board 10.

Also, an image signal may be received from an external device. For example, an image signal may be received from an external device such as a personal computer, an audio/video (AV) device, a smart phone, a tablet PC, or a smart pad, etc. An image signal may be provided as data received through a network such as the Internet, etc. In this case, the display apparatus 1 may further include a communicator to communicate externally through a network. In addition, an image signal may be provided as data stored in a flash memory, a hard disk, or nonvolatile storage. The storage may be provided externally or internally in the display apparatus 1. In the case in which the storage is provided externally to the display apparatus 1, a connector may be provided for connecting the storage and the display apparatus 1. The communicator and the connector may be provided in the image board 10.

The image processor provided in the image board 10 performs various preset imaging processes with respect to an image signal. The image processor outputs the processed image signal to the display 30 so that the display 30 can display an image based on the processed image signal.

The imaging processes performed by the image processor may, for example, include decoding corresponding to various image formats, de-interlacing, frame refresh rate conversion, scaling, noise reduction for improving image quality, detail enhancement, line scanning, etc. without limitation.

The image processor may be achieved by an individual module for independently performing each of the processes, or it may be achieved by a system-on-chip (SoC) in which various functions corresponding to the processes are integrated. For example, the image board 10 may be achieved in such a manner that circuit elements, such as various chipsets for implementing the respective processes of the image processor, a memory, electronic components, wiring lines, etc., are mounted on a printed circuit board (PCB).

On the image board 10, an integrated circuit (IC) chip 100 may be mounted as a main chip including a central processing unit (CPU) or an application processor (AP). According to an exemplary embodiment, the IC chip 100 includes the CPU for generally controlling operations of the display apparatus 1. For example, the CPU may control an imaging process of the image processor, a control operation corresponding to a command received through a remote controller, a user input unit, a networking process of the communicator with the exterior, etc. Next, a system in which the IC chip 100 is achieved with a CPU will be described.

Further, the image board 10 may include a timing controller (e.g., a "T-con") 12 that is coupled to an anterior end of a panel of the display 30 and controls a driver and improves image quality. FIG. 1 illustrates an example in which the timing controller 12, according to an exemplary embodiment, is provided in the image board 10. However, the disclosure is not limited to this. For example, the timing controller 12 may be separate from the image board 10.

In display apparatus 1, according to an exemplary embodiment, the image receiver 11, the image processor, and the CPU, may all be provided in the single image board 10. Of course, this is only an example. For example, the image receiver, the image processor and the CPU may be respectively arranged in a plurality of printed circuit boards connected to communicate with one another. In addition, the image board 10 may be accommodated in a casing.

The power supply 20 may perform a function of supplying electric power to the display apparatus 1. According to an exemplary embodiment, the power supply 20 may be a power supplying unit that supplies operation power to the IC chip 100 of the image board 10. The IC chip 100 operates by receiving a core voltage Vcore from the power supply 20.

The display 30 displays an image based on an image signal processed by the image processor. For example, the display 30 may be achieved by liquid crystal, plasma, a light emitting diode (LED), an organic light-emitting diode (OLED), a surface-conduction electron-emitter, a carbon nano-tube (CNT), nano-crystal, etc., for a flat panel display (FPD) or other similar displays, but it is not limited to these examples.

The display 30 may include additional elements in accordance with types. For example, the display 30 may include a panel for displaying an image. If the display 30 is achieved by the liquid crystal or the light emitting diode (LED), a light source (e.g., a backlight unit) may be provided for emitting light to the panel.

Further, the display 30 may include a driver for driving the panel, and the driver may be achieved with an independent PCB provided with at least one circuit device or it may be included in the image board 10. Alternatively, the driver may be included in the display 30, and the light source and the driver may be achieved by a single device.

Figure 2:
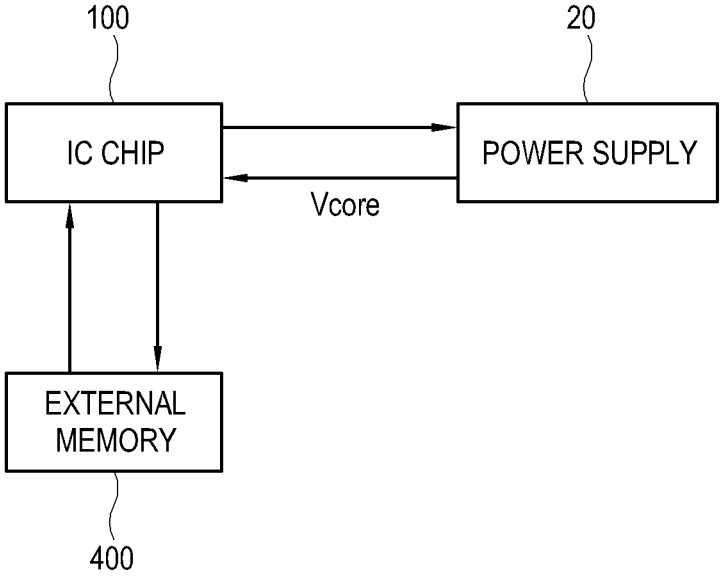
FIGS. 2 and 3 are block diagrams illustrating a power control module provided in an IC chip according to an exemplary embodiment.
Figure 3:
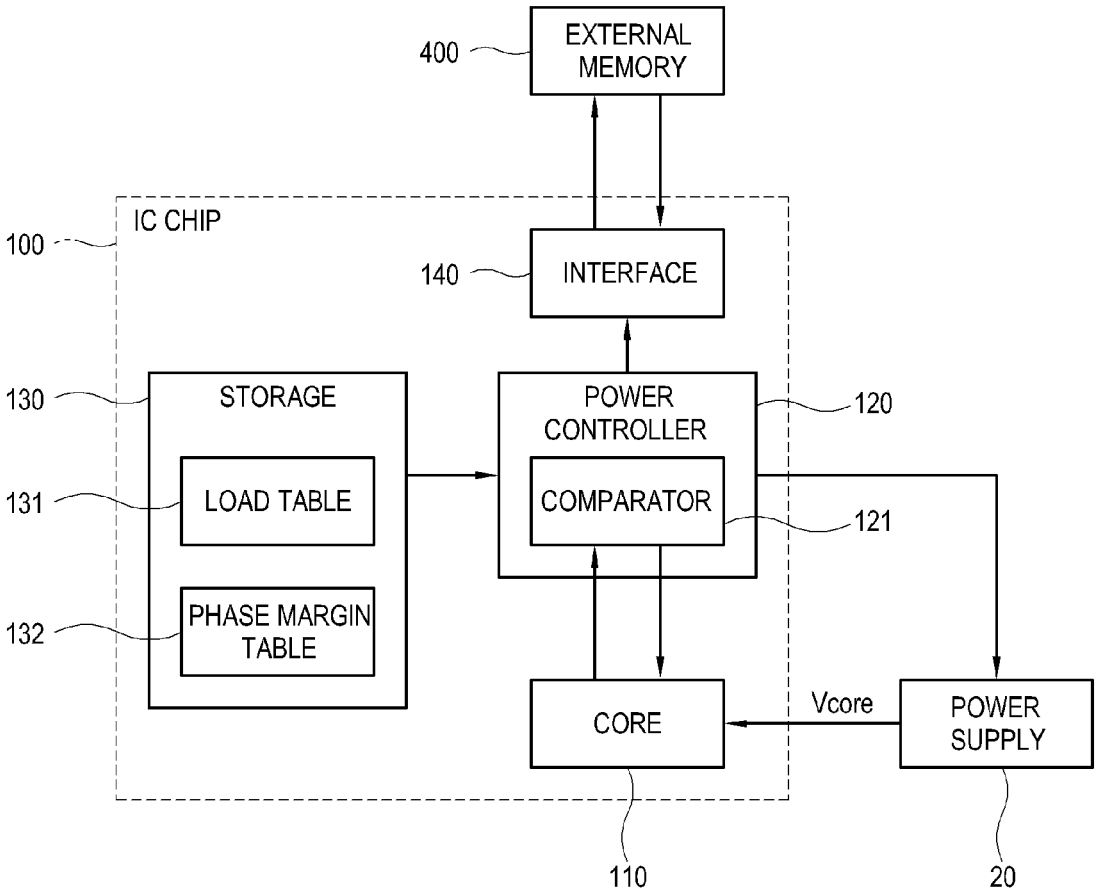

FIGS. 2 and 3 are block diagrams showing a power control module provided in the IC chip 100 according to an exemplary embodiment.

The IC chip 100, e.g., the CPU, controls general operations of the display apparatus 1, controls signal flow between internal elements, and processes data. According to an exemplary embodiment, the IC chip 100 may include a power controller 120 that controls power supplied from the power supply 20 to the IC chip 100.

As shown in FIG. 2, the IC chip 100 may operate with power Vcore supplied from the power supply 20 and perform data communication with an external memory 400. The external memory 400 may include at least one of a nonvolatile memory, a volatile memory, a flash memory, a hard disk drive (HDD) and a solid state drive (SSD). The external memory 400 is accessed under control of the CPU, in which reading/recording/modifying/deleting/updating is performed by the CPU. According to an exemplary embodiment, the external memory 400 may be mounted to the image board 10 or provided separate from the image board 10.

As shown in FIG. 3, according to an exemplary embodiment, the IC chip 100 includes one or more cores 110, a power controller 120 for controlling electric power supplied to the IC chip 100, a storage 130 for storing data, and an interface (e.g., a "memory interface unit (MIU)") 140 for transmitting and receiving data to and from the external memory 400.

The power controller 120 controls the power supply 20 so that the core voltage Vcore needed for operating the CPU can be supplied to the IC chip 100. In an exemplary embodiment, the core voltage supplied from the power supply 20 may be 1.1V, but it is not limited thereto.

Alternatively, the core voltage may be 2.2V, 3.3V, etc. The power controller 120 may include a comparator 121 to compare an actual voltage of the core voltage with a preset reference voltage.

The storage 130 may be achieved by a non-volatile memory, in which reading/recording/modifying/deleting/updating is performed by the power controller 120. The storage 130 may store a load table 131 in which a CPU load amount is set according to functions of the display apparatus 1, and a phase margin table 132 in which a plurality of phase margin values are set according to a plurality of preset voltage sections (e.g., voltage ranges).

In an exemplary embodiment, the power controller 120 and the storage 130 provided inside the IC chip 100 may be called a power control module.

The interface 140 serves as an input/output interface to read data from the external memory 400 and write data to the external memory 400.

The interface 140 performs data communication with the external memory 400 by the core voltage Vcore supplied from the power supply 20 to the IC chip 100. Here, a preset phase margin may be applied as an available phase range to the core voltage. In an exemplary embodiment, data communication of the interface 140 may be included in a MIU phase margin function.

The power controller 120 monitors an actual voltage level of the core voltage supplied from the power supply 20 to the IC chip 100, and adjusts the phase margin of the voltage to correspond to the actual voltage, i.e., the voltage detected by the monitoring.

Figure 4:
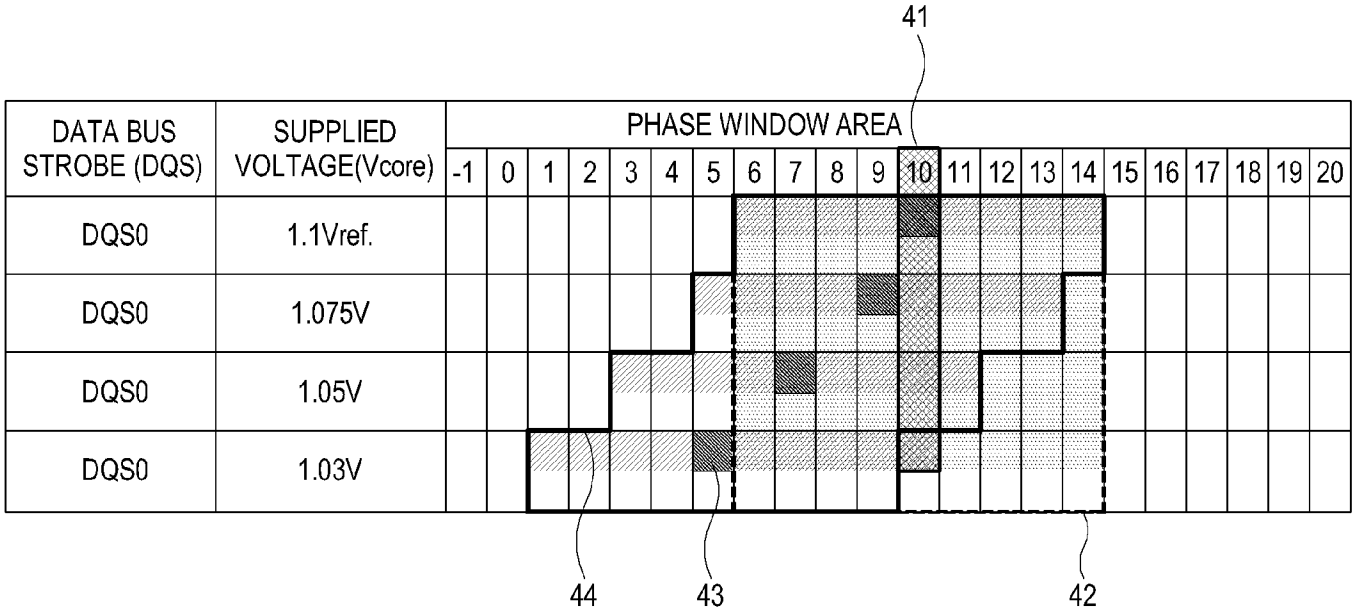
FIGS. 4 to 6 are views illustrating an adjustment of a phase margin due to fluctuation in a supply voltage according to an exemplary embodiment.
Figure 5:
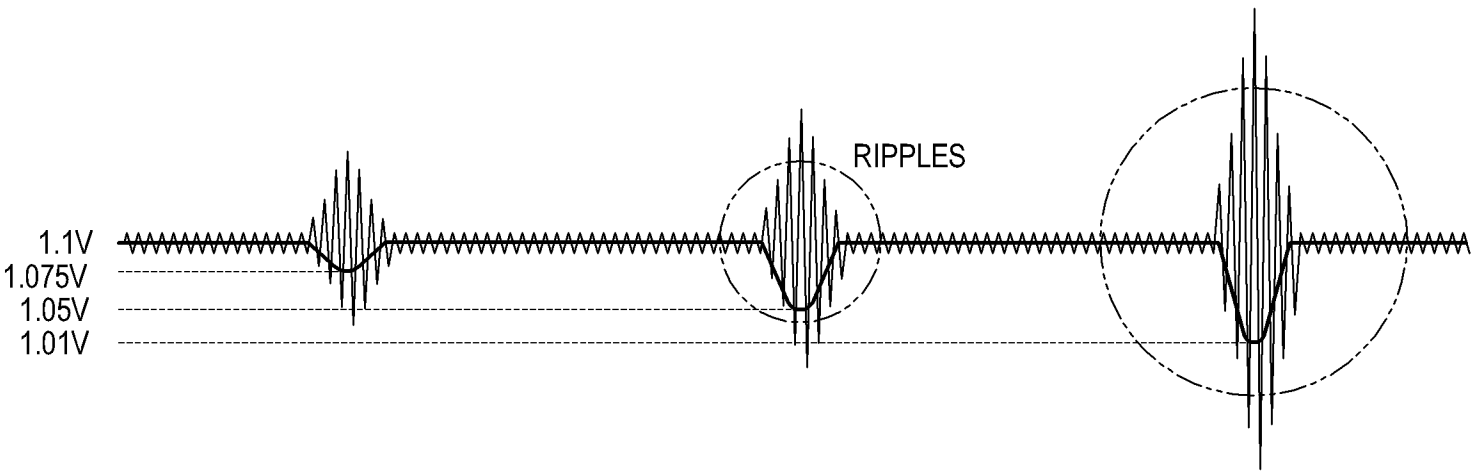
Figure 6:
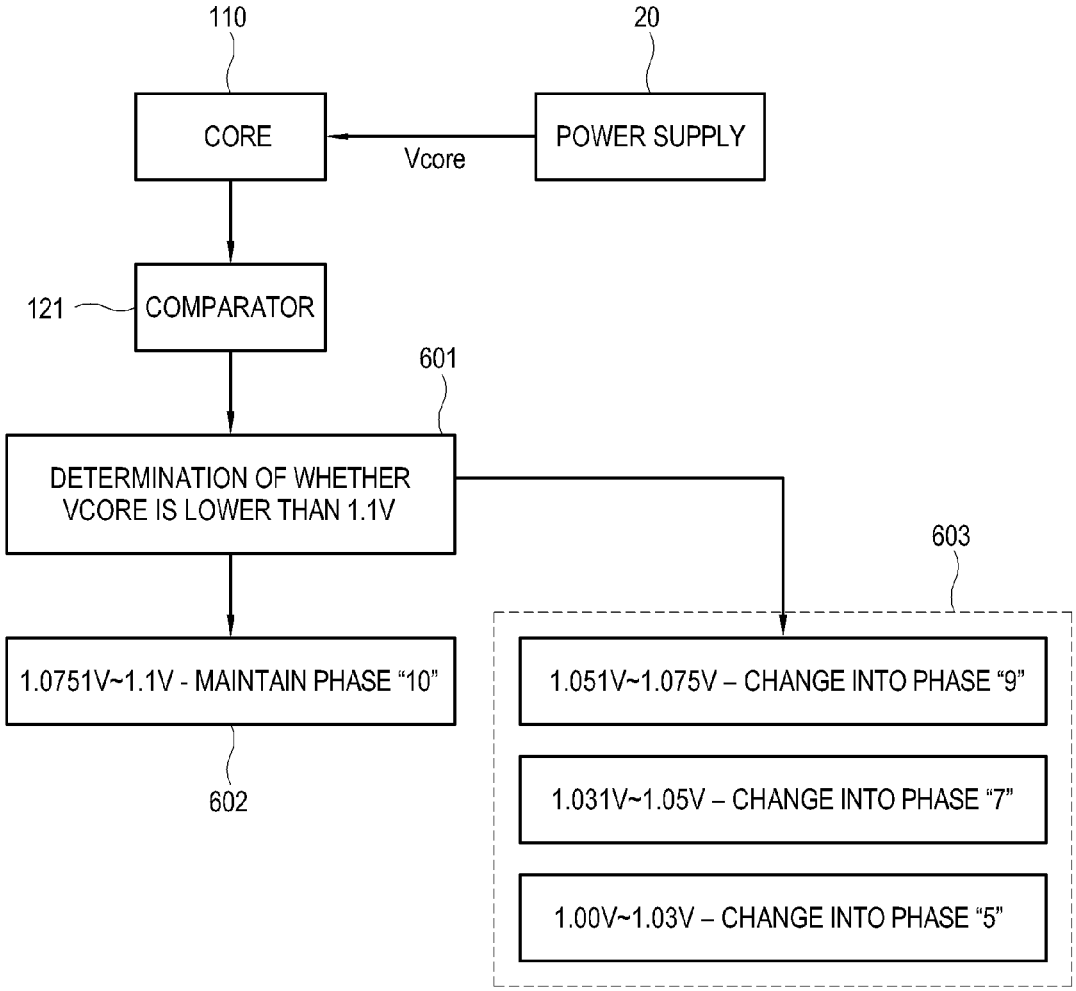

FIGS. 4 to 6 are views illustrating an adjustment of a phase margin due to fluctuation in a supply voltage according to an exemplary embodiment. FIG. 4 shows experimental results in which a data bus strobe through the interface 140 is measured using data quality services (DQS), in accordance with change in the supply voltage Vcore.

Typically, the IC chip 100 starts operating with respect to a phase value set when initially driven and a phase margin range corresponding to the phase value. For example, as shown in FIG. 4, when a reference supply voltage is 1.1V, the phase value (41) is set to "10" and the phase margin (42) ranges "6" to "14". Referring to FIG. 4, the range of the phase margin is determined by a corresponding phase window area, and the phase value corresponds to a center value of the phase margin.

In display apparatus 1, if a load caused by an execution of functions, e.g., a CPU load, is high, then ripples generated in voltage may become larger as shown in FIG. 5 and thus, a level of an actual voltage supplied to the IC chip 100 (Vcore average) may be decreased. Usually, the generation of ripples increases in voltage when the CPU load is high. Further, few ripples are generated when the CPU load is low, and therefore the actual voltage (Vcore average) is only slightly varied from the initial setting value (1.1V).

When the load increases and thus the level of the actual voltage is rapidly lowered, for example, when the voltage of FIG. 4 is dropped to 1.01V, a phase value (i.e., a center value) (43) gets out of the existing phase margin region (42) because the phase margin (42) is maintained between "6" and "14" without change even though the phase value needs to be changed to "5" corresponding to the dropped voltage 1.01V. Therefore, a difference in characteristics of the IC chip 100 is not properly compensated, and an error may occur in processing data communication with the external memory 400.

To prevent this, the power controller 120, according to an exemplary embodiment, analyzes the CPU load caused by the execution function of the display apparatus 1, and monitors the actual voltage of the core voltage supplied to the IC chip 100 when the CPU load is equal to or higher than a preset reference value.

The load table 131 stores information about a CPU load amount according to the functions of the display apparatus 1. For example, the load table 131 may store information about CPU load amounts for respectively processing image signals when the qualities (e.g., the resolutions) of the displayed image are ultra high definition (UHD), full high definition (FHD) and high definition (HD); a CPU load amount for processing a 3D image; a CPU load amount when a camera is activated; and a CPU load amount for executing each application, etc. Further, the load table 131 may further store a reference value for the CPU load.

The power controller 120 analyzes the CPU load for functions currently executed by a user's selection in display apparatus 1 with reference to the load table 131, and starts a phase compensation function for adjusting the phase margin of the core voltage when the sum of CPU load amounts is equal to or higher than the reference value, thereby monitoring the actual voltage level of the core voltage supplied to the IC chip 100. Further, the power controller 120 adjusts the phase margin of the voltage to correspond to the voltage detected in response to the monitoring.

Also, the phase margin table 132 stores a plurality of phase margin values set according to a plurality of preset voltage sections.

As shown in FIG. 4, for example, if the core voltage is 1.1V, the plurality of voltage sections may be set into a first section between 1.076V and 1.1V (1.076V~1.1V), a second section between 1.051V and 1.075V (1.051V~1.075V), a third section between 1.031V and 1.05V (1.031V~1.05V), and a fourth section between 1.00V and 1.03V (1.00V~1.03V).

The following table 1 shows an example in which a plurality of sections and the phase values and margins corresponding to the respective sections are set when the core voltage is 1.1V.

TABLE 1

| | Reference voltage | Detected voltage | Phase value | Phase margin |
|---|---|---|---|---|
| First section | 1.1 V | 1.076 V~1.1 V | 10 | 6~14 |
| Second section | 1.075 V | 1.051 V~1.075 V | 9 | 5~13 |
| Third section | 1.05 V | 1.031 V~1.05 V | 7 | 3~11 |
| Fourth section | 1.03 V | 1.00 V~1.03 V | 5 | 1~9 |

Specifically, the power controller 120 continuously checks the actual voltage (Vcore average) supplied to the IC chip 100, and uses the comparator 121 to determine whether the actually detected voltage level (e.g., an instantaneous voltage) of the core voltage is lower than the reference voltage of 1.1V. The comparator 121 compares the detected voltages with the plurality of reference voltages respectively corresponding to the plurality of preset voltage sections (e.g., the first to fourth sections).

The power controller 120 determines which of the first to fourth sections includes the detected voltage, based on the output of the comparator 121, and adjusts the phase margin of the core voltage so that the phase margin value can be adjusted corresponding to the voltage section including the detected voltage.

Referring to one or more exemplary embodiments shown in FIGS. 4 and 6, if the detected voltage is lower than 1.1V (601), such as 1.076V, the phase value (i.e., the center value) is maintained to have "10" and the phase margin (i.e., a phase window area) is also maintained to have the initial set range of "6" to "14" (602). On the other hand, if the detected voltage is 1.053V, the phase value is changed into "9" and the phase margin is changed into "5" to "13". If the detected voltage is 1.04V, the phase value is changed into "7" and the phase margin is changed into "3" to "11". If the detected voltage is 1.02V, the phase value is changed into "5" and the phase margin is changed into "1" to "9" (603).

According to an exemplary embodiment, the phase margin is adjusted as the level of actually detected voltage is changed. If the actual voltage is decreased, the phase window area 43 corresponding to the phase margin is shifted down as shown in FIG. 4.

Therefore, according to an exemplary embodiment, a phase setting value moves automatically in accordance with the actual voltage supplied to the IC chip 100, thereby securing a stable phase margin for the operation of the MIU 140.

This is equally applied to fast-fast (FF), slow-slow (SS) and similar process corners of a chip manufacturing, thereby improving quality in the manufacturing process. For example, in the case of a chip having a characteristic of SS, it may be difficult to read data at a low voltage, but, according to an exemplary embodiment, stable operations may be enabled by a phase shift according to the characteristic.

Next, a power control process for display apparatus 1 according to an exemplary embodiment will be described with reference to accompanying drawings. The following power control according to an exemplary embodiment provides an automatic MIU phase margin adjust function for power ripples.

Figure 7:
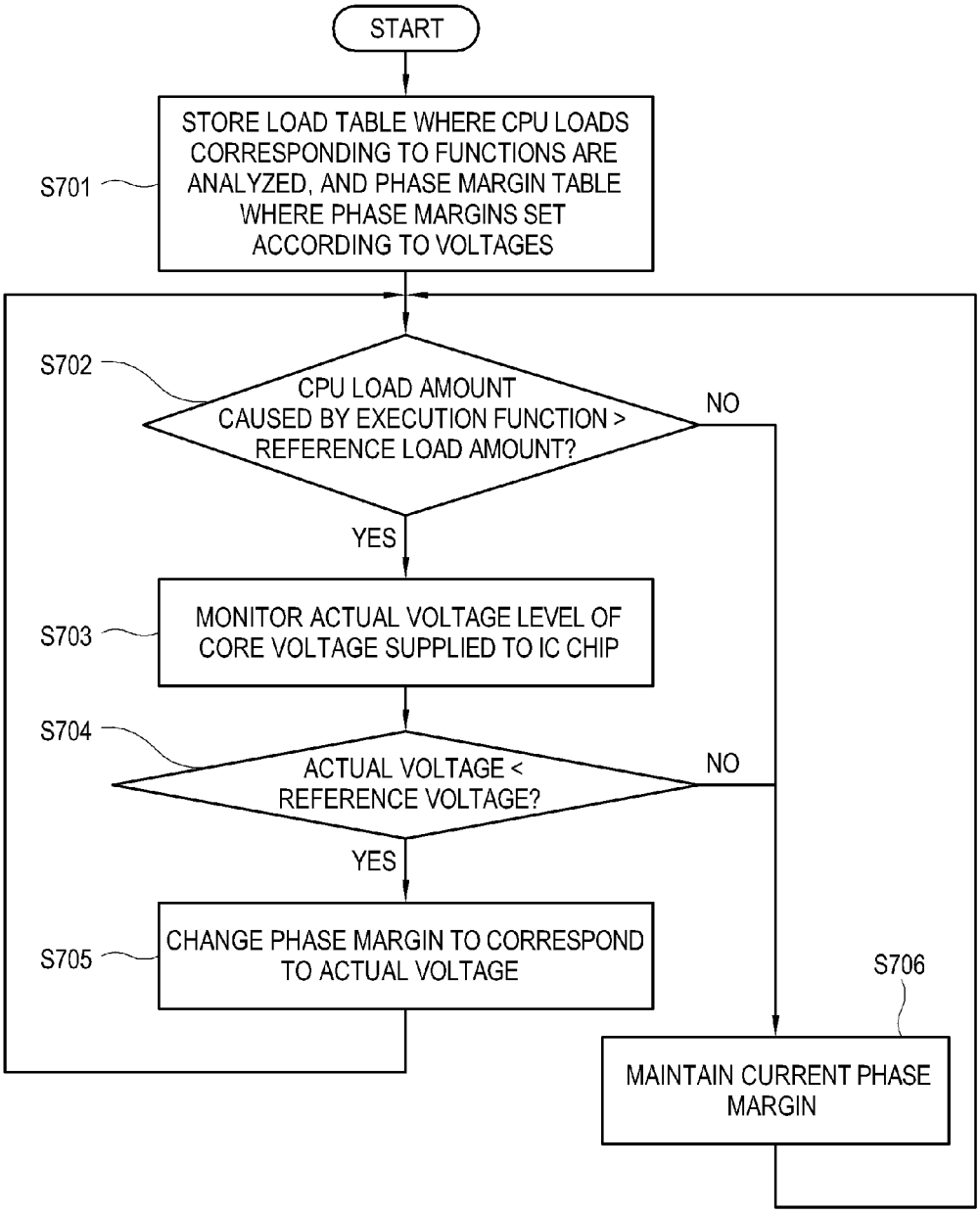
FIG. 7 is a flowchart illustrating a power control method of a display apparatus according to an exemplary embodiment.

FIG. 7 is a flowchart showing a power control method of the display apparatus 1 according to an exemplary embodiment.

As shown in FIG. 7, the storage 130 of the IC chip 100 stores the load table 131 where the CPU load is analyzed according to the functions of the display apparatus 1, and the phase margin table 132 where the phase margin is set according to voltages (S701). The phase margin table may include a plurality of phase margin values respectively set corresponding to the plurality of preset voltage sections.

The power controller 120 compares the CPU load amount corresponding to the execution function of the display apparatus 1 with the preset reference load amount (S702).

As a result of the comparison in operation S702, if the CPU load amount is larger than the reference load amount, the power controller 120 monitors the actual voltage level of the core voltage supplied to the IC chip 100 (S703).

In accordance with the monitoring in operation S703, the power controller 120 detects the actual voltage of the core voltage Vcore, and compares the detected actual voltage with the preset reference voltage (S704). The power controller 120 may use the comparator 121 to compare the actual voltage with the reference voltage. The comparator 121 has the plurality of reference voltages and compares the detected actual voltage with the plurality of reference voltages respectively corresponding to the plurality of preset voltage sections.

As a result of the comparison in operation S704, if the actual voltage is lower than the reference voltage, the power controller 120 controls the phase margin of the voltage to be adjusted, i.e., it is shifted corresponding to the actual voltage detected in operation S704 (S705). The power controller 120 may adjust the phase margin so that the phase margin value can be applied corresponding to the voltage section, in which the voltage detected in operation S704 is included, among the plurality of voltage sections based on the output of the comparator 121.

As a result of the comparison in operation S704, if the actual voltage is equal to the reference voltage, the power controller 120 maintains the current phase margin (S706).

Further, the interface 140 performs data communication with the external memory 400 by voltage to which the phase margin adjusted in operation S705 or maintained in operation S706 is applied.

Meanwhile, an exemplary embodiment shown in FIG. 7 illustrates an example in which the power controller 120 monitors the actual voltage level only when it is determined in operation S702 that the CPU load amount caused by the executed function of the display apparatus 1 is larger than the reference load amount. However, according to another exemplary embodiment, the power controller 120 may continuously monitor the actual voltage level and adjust the phase margin corresponding to the detected actual voltage without the determination operation S702, i.e., regardless of the CPU load amount.

As described above, according to an exemplary embodiment, the phase margin may be adjusted in accordance with the actual voltage supplied to the IC chip 100, thereby compensating for voltage fluctuation due to instantaneously varying ripples and stably driving a system.

Thus, the IC chip of the display apparatus, e.g., the TV, is prevented from latch-up, etc., thereby eliminating unstable factors and stabilizing the performance of the apparatus. It is also possible to reduce a material cost without overdesign since a separate LC filter, etc., for eliminating the ripples at a power terminal is not needed in the apparatus.

Further, a semiconductor yield may be improved by cost reduction due to extension of a fair quality range on a chip process. Since the PCB design process is improved and a performance test period is shortened, a development period is advantageously shortened.

Although one or more exemplary embodiments have been shown and described, it should be appreciated by those skilled in the art that changes may be made in the exemplary embodiments without departing from the principles and spirit of the inventive concepts, the scope of which is defined in the appended claims and their equivalents.

What is claimed is:

1. A display apparatus comprising:

a power supply configured to provide power to components of the display apparatus;

a circuit board;

an integrated circuit (IC) mounted to the circuit board, the integrated circuit configured to process an image signal; and a display configured to display an image corresponding to the processed image signal, wherein the IC comprises a power controller configured to monitor a voltage level of a core voltage provided by the power supply to the IC and adjust a phase margin of the core voltage based on the monitoring.

2. The display apparatus according to claim 1, wherein the IC further comprises an interface that is configured to perform data communication with an external memory, and wherein the power controller is further configured to apply the adjusted phase margin to a voltage for the data communication of the interface.

3. The display apparatus according to claim 2, wherein the external memory is mounted to the circuit board.

4. The display apparatus according to claim 1, further comprising a memory configured to store a plurality of phase margin values respectively corresponding to a plurality of preset voltage ranges, wherein the power controller is further configured to adjust the phase margin to apply a phase margin value corresponding to a voltage range of the voltage.

5. The display apparatus according to claim 1, wherein the power controller is further configured to analyze a CPU load caused by an execution of functions in the display apparatus, and monitor the voltage level of the core voltage provided to the IC in response to the CPU load being equal to or greater than a preset reference value.

6. The display apparatus according to claim 5, further comprising a memory configured to store information related to CPU load amounts corresponding to the functions of the display apparatus.

7. The display apparatus according to claim 1, further comprising a comparator configured to compare the detected voltage with a preset reference voltage, wherein the power controller is further configured to adjust the phase margin according to a comparison result of the comparator.

8. The display apparatus according to claim 7, wherein the comparator is further configured to compare the detected voltage with a plurality of preset reference voltages that respectively correspond to a plurality of preset voltage ranges, and wherein the power controller is further configured to adjust the phase margin to apply a phase margin corresponding to a voltage range of the detected voltage, according to a comparison result of the comparator.

9. A power control method of a display apparatus comprising a circuit board having an integrated circuit (IC) mounted thereto, the method comprising:

monitoring a voltage value of a core voltage provided from a power supply to the IC; and adjusting a phase margin of the core voltage based on the monitoring.

10. The method according to claim 9, further comprising applying the adjusted phase margin for data communication with an external memory.

11. The method according to claim 9, further comprising storing a phase margin table in which a plurality of phase margin values correspond to a plurality of preset voltage ranges.

12. The method according to claim 10, further comprising analyzing a central processing unit (CPU) load caused by an execution of functions in the display apparatus, and in response to the CPU load being equal to or greater than a preset reference value, monitoring the voltage level of the core voltage provided to the IC.

13. The method according to claim 12, further comprising storing a load table in which CPU load amounts correspond to the functions of the display apparatus.

14. The method according to claim 9, further comprising comparing the detected voltage with a preset reference voltage, and adjusting the phase margin in accordance with a result of the comparing.

15. The method according to claim 14, further comprising:

comparing the detected voltage with a plurality of preset reference voltages respectively corresponding to a plurality of preset voltage ranges; and adjusting the phase margin by applying a phase margin value corresponding to the preset voltage range of the detected voltage.

16. A power control module provided in an integrated circuit (IC) comprising a central processing unit (CPU), the power control module comprising:

a power controller configured to monitor a voltage level of a core voltage provided by a power supply to the IC, and adjust a phase margin of the core voltage based on the monitoring.

17. The power control module according to claim 16, wherein the power controller is further configured to apply the adjusted phase margin to a voltage for data communication between the IC and an external memory.

18. The power control module according to claim 16, further comprising a memory configured to store a plurality of phase margin values respectively corresponding to a plurality of preset voltage ranges, wherein the power controller is further configured to adjust the phase margin to a value corresponding to the preset range of the detected voltage.

19. The power control module according to claim 16, wherein the power controller further comprises a comparator configured to compare the detected voltage with a preset reference voltage, and adjust the phase margin according to a comparison result of the comparator.

20. The power control module according to claim 19, wherein the comparator is further configured to compare the detected voltage with a plurality of reference voltages respectively corresponding to a plurality of preset voltage ranges, and wherein the power controller is further configured to adjust the phase margin to apply a phase margin corresponding to the preset voltage ranges of the detected voltage.

* * * * *